United States Patent [19]

Chu et al.

[11] Patent Number: 4,552,784

[45] Date of Patent: Nov. 12, 1985

[54] METHOD OF COATING A SUBSTRATE WITH A RAPIDLY SOLIDIFIED METAL

[75] Inventors: Huai-Pu Chu; Charles L. Staugaitis, both of Silver Spring, Md.

[73] Assignee: The United States of America as represented by the United States National Aeronautics and Space Administration, Washington, D.C.

[21] Appl. No.: 590,925

[22] Filed: Mar. 19, 1984

[51] Int. Cl.[4] ..... B05D 1/12

[52] U.S. Cl. ..... 427/192; 427/191; 427/421; 427/427

[58] Field of Search ..... 427/421, 427, 191, 192

[56] References Cited

U.S. PATENT DOCUMENTS

| | | | |
|---|---|---|---|
| 3,754,976 | 8/1973 | Babecki et al. | 117/105 |
| 3,765,923 | 10/1973 | Bender-Christensen | 117/26 |
| 3,787,191 | 1/1974 | Duncan | 29/191 |
| 4,051,275 | 9/1977 | Forestek | 427/201 |
| 4,269,868 | 5/1981 | Livsey | 427/53.1 |
| 4,287,740 | 9/1981 | Kumar | 72/40 |
| 4,300,474 | 11/1981 | Livsey | 118/641 |
| 4,330,027 | 5/1982 | Narasimhan | 164/461 |

OTHER PUBLICATIONS

The Direct Powder-Rolling Process for Producing Thin Metal Strip, Ro et al, Journal of Metals, Jan., 1983.

Amorphous Metals Update, Improve Power Supplies, Design News, Aug. 23, 1982.

Microstructure and Properties of Rapidly Solidified Alloys, Shechtman et al, NASA Contractor Report 172377, Jul. 1984.

Rapid Solidification of Metallic Particulates, Grant, Journal of Metals, Jan. 1983, pp. 20–27.

Metal Magic Creates Glassy Steel with Strange Magnetic Ability, Miller, Industrial R&D, Jun. 1983, p. 47.

Glassy Alloys—New Class of Corrosion Resistant Coatings, Diegle et al, SAMPE Quarterly, Jan. 1982.

*Primary Examiner*—Shrive P. Beck

*Attorney, Agent, or Firm*—John O. Tresansky; John R. Manning; Ronald F. Sandler

[57] ABSTRACT

A method for coating a substrate with rapidly solidified metal which comprises spraying a mixture of rapidly solidified metal powder and small peening particles at high velocity against the substrate, said velocity being sufficient for the rapidly solidified metal powder and peening particles to impact the substrate and simultaneously bond the metal powder to the substrate. If the substrate is metallic, the method may provide the simultaneous mechanical working of the substrate surface.

17 Claims, No Drawings

METHOD OF COATING A SUBSTRATE WITH A RAPIDLY SOLIDIFIED METAL

ORIGIN OF THE INVENTION

The invention described herein was made by employees of the United States Government, and may be manufactured and used by or for the Government for governmental purposes without the payment of any royalties thereon or therefor.

TECHNICAL FIELD

This invention pertains to metal coating processes and, more particularly, to the process of coating a substrate with a rapidly solidified metal.

BACKGROUND ART

Numerous methods are practiced for the metallic plating or coating of substrates, usually for anti-corrosive and/or decorative purposes or to provide a wear resistance or a conductive layer. These methods include the application of metallic coatings to substrates by electro-chemical and chemical deposition, in tanks of aqueous solutions of metal salts, by immersion of substrates into molten baths of the coating metal and by spray and brush application of the coating metal to substrates in the form of a paint.

Although these prior art techniques have enjoyed some commercial success, they are not without their shortcomings. Many of these prior art techniques, for instance, involve the use of hazardous chemicals and/or fumes or result in hydrogen embrittlement. Others are characterized by less than desirable deposition rates or the requirement for complex and costly equipment. Most prior art techniques do not effect any mechanical working or hardening of the substrate surface.

One prior art technique has provided a safe, simple and inexpensive method for the application of a metal coating to a substrate while simultaneously hardening the substrate surface. This method has employed substantially standard shot-peening apparatus to apply a mixture of peening particles and metallic coating powders to the substrate material. In this method, the peening particles drive the metallic coating particles onto the substrate while simultaneously mechanically working (hardening) the substrate surface. This method has proved useful with a broad range of substrates, traditional peening particles such as glass beads and metal shot, and various conventional metal powders made from ingot metallurgy. Illustrative of metallic powders that may be used in this method are aluminum, nickel, silver, gold, tungsten, copper and zinc. The prior art did not employ this method for the application of rapidly solidified (R-S) metal coatings because this method was deemed by some in the art to be inapplicable to the application of R-S metal powders which are made directly from molten metal and are generally characterized as very fine powders with either amorphous or microcrystalline structure. As the mechanism is understood, the energy (work) produced by the peening particles at the substrate surface has been considered by some to be insufficient to create a bond of the R-S metal powder to the substrate surface.

R-S metal powder coatings have been of interest for a considerable period of time because the metal is endowed with a refined microstructure and microchemistry and, consequently, the resulting structure is superior in terms of mechanical properties such as strength, wear and corrosion resistance. Moreover, R-S metals, whether in the amorphous or microcrystalline state, form superior anti-corrosive layers which are long-lasting, both at room and at moderately high temperatures. Prior art methods of applying R-S metal powders to substrates as a coating have included sputtering, ion plating, laser glazing and ion implantation. In spite of the continuing interest in R-S metals and resulting extensive research in this area, none of these methods have proved commercially viable because of such factors as complexity, cost and undesirable results. As an example, laser glazing has not wide acceptance because this process results in the formation of micro-cracks, thereby resulting in a non-uniform surface. Further, the process presents safety problems, requires highly trained personnel, is complex, expensive and time consuming and not adapted to large surface applications.

STATEMENT OF THE INVENTION

Accordingly, it is an object of this invention to provide a safe, rapid, inexpensive and simple method of coating substrates with rapidly solidified metals.

It is another object of the invention to provide a method of uniformly coating substrates with rapidly solidified metals.

It is yet another object of the invention to provide a method of coating substrates with rapidly solidified metals where the coating is not subject to hydrogen embrittlement.

It is still another object of the invention to provide a method of coating substrates with rapidly solidified metals where the substrate surface may also be simultaneously mechanically worked.

Briefly, these and other objects are achieved in a method where a mixture of R-S metal powder and small, solid peening particles is sprayed at high velocity by a nozzle against a surface, said velocity being sufficient to cause the R-S metal powder and peening particles to simultaneously impact the surface, whereby the peening particles simultaneously bond the rapidly solidified metal powder to the surface.

DETAILED DESCRIPTION OF THE INVENTION

The process of coating according to this invention may be carried out by the use of substantially conventional peening apparatus. Initially, a supply of small-size spherical peening particles, such as glass beads, and R-S metal, is mixed in a hopper or at the point of ejection before being sprayed in a stream upon a substrate. Any of several conventional compressed air actuated nozzles may be used. The nozzles may require some minor modification depending on the various peening particles, R-S metal powders, and substrates employed. Although the preferred small peening particles of the invention are spherical peening particles such as glass beads, other suitable peening particles include metal shot, ceramic beads and the like. Further, the peening particles need not necessarily be spherical in shape and may take those forms that are generally commercially available. The size of the peening particles may be that of the conventional beads used for peening and blast cleaning. Ordinarily, the peening particles range in size from about 0.0661 inch in diameter to about 0.0010 inch in diameter. Any R-S metal powder of varying chemical compositions and particle shape, e.g., flake or spherical, is suitable as the coating material. Illustrative of the rapidly solidified metal powders that may be used are aluminum, titanium, nickel, iron, copper, zinc, and their alloys, etc. These are deemed not to be limiting in any sense because new R-S metal powders are being continuously developed. In general, the size of commercially available rapidly solidified metal powders will range from about −100 mesh to +400 mesh, and finer, any one of which is suitable for use in the process of the invention. The metal powder size selected, however, should be no longer than about one half of the peening particle size to achieve a good coating. The precise size of metal powder employed will depend in large part upon practical considerations such as the speed of the process and the thickness of coating desired.

A unique feature of the invention is that two or more different R-S metal powders may be introduced into the peening particle stream simultaneously or alternately, or metal and non-metal powders may be applied together in layers. This feature has been found to offer a number of practical uses and advantages. For example, one stream may be a soft metal powder to provide electrical or thermal conduction and the other stream may be a hard metal powder to provide wear resistance.

The proportions of the peening particles to metal powder employed in the process may vary widely, with the proportions selected depending primarily upon the substrate, the air pressure applied to the nozzle and the degree of peening or coating desired. If, for instance, it is desired to minimize peening and maximize plating, a ratio of R-S metal powder to peening particles of about 50:50 can be employed. Although ratios of powder to peening particles in excess of 50:50 are employable, they generally are unnecessary and frequently constitute a waste of R-S metal powder. On the other hand, if it is desired to maximize peening and minimize plating, ratios of R-S metal powder to peening particles less than 50:50, down to, for example, 10:90, may be selected.

The air, or other gas, pressure employed in the spraying of the R-S metal powder and peening particles is of a magnitude sufficient to maintain free continuous flow and produce a peening effect at the distance the spray nozzle is held from the substrate or workpiece. The particular pressure employed in a given operation will depend on several factors such as the hardness of the substrate, the distance that the spray nozzle is held from the piece, the size and proportions of the metallic powder and peening particles, and whether peening or plating is to be favored. Also, the pressure may be varied during the course of the operation. For instance, it may be desired to operate initially at an appropriate pressure to clean the surface or to produce an intensity that hardens and introduces compressive residual stresses into the substrate, eliminates tool marks, etc., and then adjusting the intensity by changing the pressure to complete the plating operation.

The force intensity of the peening media (R-S metal powder and peening particles) can be varied by the air (or gas) pressure, the distance of the part from the nozzle, the rate of flow of the peening and plating media into the air stream, the orifice size of the nozzle, or any combination of these variables.

The substrates which can be metal plated or coated in accordance with the invention include any material having a peenable surface. Such materials include metals and alloys, such as copper, steel, magnesium, aluminum alloys, etc., plastics such as nylon, polyethylene, polypropylene, polymethacrylates, etc., fiberglass, ceramics, and the like.

In some applications of the invention it may be desirable to precondition the surface of the substrate or workpiece by first effecting the spraying with the peening particles alone before introduction of the R-S metal powder into the stream. This preconditioning may be accomplished in different forms. One form may comprise a surface cleaning operation whereby the part to be coated is cleaned with a gentle or low angle stream of peening particles to remove rust, scale, paint, etc., before introduction of the R-S metal powder into the stream, thereby improving adhesion of the coating. Another form, in the case of a metal surface, may involve peening with a high angle stream of peening particles to induce compressive stresses for fatigue and stress corrosion resistance, again before the flow of R-S metal powder is begun. Yet another form, also involving a metal surface, may comprise a combination of the surface cleaning step followed by the peening step before the R-S metal powder is introduced into the stream.

The plating process is preferably conducted in a suitable cabinet or work chamber. The spray of peening particles and R-S metal powder is then simply directed at the desired areas of the workpiece. Areas that are not to be covered can be masked off with various pressure sensitive tapes or rubber or plastic coatings that can be removed easily at a later time. The longer the application time for a given set of conditions, the thicker will be the resulting coating. If desired, standard devices such as Almen strips, as adopted by the Society of Automotive Engineers, may be used for gauging and monitoring the intensity of the peening. Recommended Almen strip arc heights range from 0.002N to 0.012C. depending on the thickness and type of material being plated, with the lower values being used for thinner and/or softer substrates and the higher values for thicker and/or harder substrates. Upon completion of the plating operation, the peening particles used may be discarded or reclaimed, as desired. Any unused R-S metal powder may be recovered.

The spraying may be carried out by the use of several nozzles, particularly in automatic or sequential operations. The part to be coated may be moved automatically into the spray paths of the several nozzles so prepositioned that all or portions of the part being processed contacts the sprays in the order of the desired plating with the nozzles spraying out peening media consisting of small beads and powders so selected so as to produce a variety of desired surfaces. The placement of nozzles also may be arranged to produce layering of different plating materials. Additionally, the nozzles may be individually set to produce different peening intensities with different peening media. If pre-cleaning is required, the first set of nozzles would spray only the beads, without a powder, prior to any plating being accomplished.

The following are exemplary of the inventive process.

EXAMPLE I

In this example the peening process was conducted in a standard glass bead peening machine comprising an enclosed working cabinet containing a hopper and spraying equipment including a nozzle. The nozzle employed had an opening diameter of $\frac{1}{4}$ inch. A brass plate was placed in the machine $\frac{3}{4}$ of an inch away from the nozzle. Equal proportions by volume of 0.0165 to 0.0098 inch diameter glass beads and 0.0005 to 0.0003 inch diameter rapidly solidified tin alloy powder were mixed in the hopper and the admixture spray "blasted" under an air pressure of 60 psig onto the surface of the brass plate with an Almen intensity of 0.005 inch A. The nozzle moved across the plate at a rate of three inches per minute. Three passes covered an area of approximately 1.0×2.0 inches with a layer of tin alloy coating. Photomicrographs of the coated surface cross section showed that the coating was firmly bound to the substrate surface and appeared uniform. This operation resulted in a layer of coating approximately one mil in thickness.

EXAMPLE II

The procedure of Example I was repeated with the same operating parameters with the exception that the nozzle was moved across the plate at a rate of 0.6 inch per minute. The rapidly solidified metal powder was aluminum which was sieved to have particle diameters of 0.0015 inch. Deposition of the aluminum on a brass substrate was obtained using 30% or 50% powder (by volume) mixed with glass beads. Again, the Almen intensity was 0.005 inch A. The resulting coating appeared uniform.

The important variables in plating with rapidly solidifed metal powder are (1) powder particle size, (2) shot size, (3) powder material, (4) substrate material and surface condition, (5) nozzle opening size, and (6) nozzle angle and distance to substrate surface. To increase the plating action, glass shots, such as glass beads, which are larger than the metal powder should be employed and the nozzle should be directed substantially at a right angle to the substrate surface. Also, the distance between the substrate and nozzle should be kept at about one inch. Excessive peening intensity has been found to be unnecessary.

Thus, contrary to the conventional views of some skilled in art, a safe, rapid and simple process has been disclosed for applying an R-S metal coating on a surface which in uniform and immune to hydrogen embrittlement.

We claim:

1. A process for coating a substrate comprising;

providing a mixture of rapidly solidified metal powder and peening particles; and spraying said mixture at said substrate by ejection at a velocity which is sufficient to cause said rapidly solidified metal powder and said peening particles to impact said substrate and simultaneously bond said rapidly solidified metal powder to the surface of said substrate in the form of a metal coating.

2. The process of claim 1 wherein said rapidly solidified metal powder and peening particles are mixed prior to ejection.

3. The process of claim 1 wherein said rapidly solidified metal powder and peening particles are mixed at the point of ejection.

4. The process of claim 1 wherein said rapidly solidified metal powder is selected from the group consisting of aluminum, titanium, nickel, iron, copper, zinc and their alloys.

5. The process of claim 1 wherein said peening particles are glass beads.

6. The process of claim 1 wherein said rapidly solidified metal powder includes at least two different metals.

7. The process of claim 1 wherein the size of said rapidly solidified metal powder is no larger than about one half the size of said peening particles.

8. The process of claim 5 wherein said glass beads have a diameter from about 0.0098 to 0.0165 inches.

9. The process of claim 1 wherein said rapidly solidified metal powder is a tin alloy with a powder diameter from about 0.0003 to 0.0005 inch.

10. The process of claim 1 wherein said rapidly solidified metal powder is a tin alloy powder and said peening particles are glass beads which are mixed in about equal proportions by volume.

11. The process of claim 1 wherein said rapidly solidified metal powder is aluminum with a powder diameter of about 0.0015 inch.

12. The process of claim 1 wherein said rapidly solidified metal powder is aluminum and said peening particles are glass beads which are mixed in about equal proportions by volume.

13. The process of claim 1 wherein said rapidly solidified metal powder is aluminum and said peening particles are glass beads, wherein said aluminum is mixed with said beads to constitute about 30% of said mixture by volume.

14. The process of claim 1 wherein said rapidly solidified metal powder is a tin alloy with a powder diameter of from about 0.0003 to 0.0005 inch, said peening particles are glass beads with a diameter from about 0.0098 to 0.0165 inch, the powder and beads are mixed in about equal proportions by volume, and said spraying is accomplished by using compressed air with a pressure of 60 psig.

15. The process of claim 1 wherein said rapidly solidified metal powder is aluminum with a powder diameter of about 0.0015 inch, said peening particles are glass beads with a diameter from about 0.0098 to 0.0165 inch, the powder and beads being mixed in about equal proportions by volume, and said spraying is accomplished by using compressed air with a pressure of 60 psig.

16. The process of claim 1 wherein said rapidly solidified metal powder is aluminum with a powder diameter of about 0.0015 inch, said peening particles are glass beads with a diameter from about 0.0098 to 0.0165 inch, and aluminum being mixed with said beads to constitute about 30% of said mixture by volume, and said spraying is accomplished by using compressed air with a pressure of 60 psig.

17. The process of claim 1 wherein said spraying is accomplished by using compressed air with a pressure of 60 psig.

* * * * *